US009167919B2

(12) United States Patent
Walker et al.

(10) Patent No.: US 9,167,919 B2
(45) **Date of Patent: *Oct. 27, 2015**

(54) COVER FOR A MATTRESS

(75) Inventors: Harry Walker, Montreal (CA); Yair Altman, Montreal (CA)

(73) Assignee: SMARTSILK CORPORATION INC., Montreal, Quebec (CA)

( * ) Notice: Subject to any disclaimer, the term of this patent is extended or adjusted under 35 U.S.C. 154(b) by 1010 days.

This patent is subject to a terminal disclaimer.

(21) Appl. No.: 13/254,783

(22) PCT Filed: Mar. 3, 2010

(86) PCT No.: PCT/CA2010/000305

§ 371 (c)(1),
(2), (4) Date: Dec. 13, 2011

(87) PCT Pub. No.: WO2010/099614

PCT Pub. Date: Sep. 10, 2010

(65) Prior Publication Data

US 2012/0073049 A1 Mar. 29, 2012

Related U.S. Application Data

(60) Provisional application No. 61/157,044, filed on Mar. 3, 2009.

(51) Int. Cl.
*A47G 9/02* (2006.01)
*A47C 31/10* (2006.01)
(Continued)

(52) U.S. Cl.
CPC ..... *A47G 9/0246* (2013.01); *A47C 27/007* (2013.01); *A47C 31/007* (2013.01); *A47C 31/105* (2013.01); *A47G 2009/001* (2013.01)

(58) Field of Classification Search
CPC .... A47C 31/105; A47C 31/10; A47C 31/007; A47C 27/007; A47C 27/002; A47G 9/02; A47G 9/0238; A47G 9/0246; A47G 2009/001; A47G 9/00
USPC ..... 5/500, 502, 499, 482, 737, 738
See application file for complete search history.

(56) References Cited

U.S. PATENT DOCUMENTS 1,531,547 A * 3/1925 Edelson et al. ..... 5/719
1,892,679 A * 1/1933 Penner et al. ..... 5/722
(Continued)

FOREIGN PATENT DOCUMENTS

AU 573089 5/1988
CA 1219090 3/1987
(Continued)

OTHER PUBLICATIONS

Tempur-Pedic, The GrandBed by Tempur-Pedic(TM)—The Healthy Back Store, Last consulted Oct. 14, 2009, www.healthyback.com/products/tempur-pedic/grandbed-by-tempur-pedic/113.
(Continued)

*Primary Examiner* — Robert G Santos
(74) *Attorney, Agent, or Firm* — McClure, Qualey & Rodack, LLP

(57) ABSTRACT

A cover for a mattress includes a lateral panel for extending across the lateral surface of the mattress and a top panel for covering the top surface of the mattress. The top panel includes a breathable inner liner made of a non-woven material, a breathable outer shell covering the inner liner, and a silk floss fill retained between the inner liner and the outer shell. A mattress also includes the inner liner, outer shell and silk floss fill. A cover having an adjustment feature which includes a channel, an elongate elastic strip extending therein, a first connector and plurality of complementary second connectors disposed along the strip.

13 Claims, 3 Drawing Sheets

(51) Int. Cl.

| | |
|---|---|
| ***A47C 31/00*** | (2006.01) |
| ***A47C 27/00*** | (2006.01) |
| *A47G 9/00* | (2006.01) |

(56) References Cited

U.S. PATENT DOCUMENTS

| | | | | |
|---|---|---|---|---|
| 2,371,276 | A * | 3/1945 | Adams | 5/655.8 |
| 4,656,681 | A | 4/1987 | Alexander et al. | |
| 5,809,593 | A * | 9/1998 | Edwards | 5/497 |
| 6,964,074 | B2 | 11/2005 | Carlitz | |
| 7,930,779 | B2 * | 4/2011 | Marrache | 5/498 |
| 8,448,273 | B2 * | 5/2013 | Walker et al. | 5/636 |
| 2002/0112291 | A1 * | 8/2002 | Barman et al. | 5/716 |
| 2003/0121101 | A1 * | 7/2003 | Corzani et al. | 5/487 |
| 2003/0163870 | A1 * | 9/2003 | Porter et al. | 5/490 |
| 2003/0172458 | A1 * | 9/2003 | Bonfanti et al. | 5/490 |
| 2007/0245493 | A1 | 10/2007 | Leifermann et al. | |
| 2009/0144900 | A1 * | 6/2009 | Marrache | 5/484 |
| 2010/0139002 | A1 * | 6/2010 | Walker et al. | 5/636 |
| 2012/0073049 | A1 * | 3/2012 | Walker et al. | 5/500 |
| 2014/0359948 | A1 * | 12/2014 | Middlesworth et al. | 5/690 |
| 2015/0135435 | A1 * | 5/2015 | Ueda et al. | A47G 9/02 |

FOREIGN PATENT DOCUMENTS

| | | | |
|---|---|---|---|
| CA | 1272308 | | 7/1990 |
| CA | 1330602 | | 7/1994 |
| DE | 202004006754 | | 8/2004 |
| EP | 1576908 | A2 | 9/2005 |
| EP | 1576908 | A3 | 9/2005 |
| GB | 454452 | | 10/1936 |
| JP | 10155623 | | 6/1998 |
| WO | 03030669 | | 4/2003 |
| WO | 2006009974 | | 1/2006 |

OTHER PUBLICATIONS

Green Sleep, Mattress Pillow, Green Sleep Organic Mattress, Last consulted Oct. 14, 2009, www.mattress-pillow.com/green-sleep-organic-mattress/.

Silksation, Silk duvets from quality silk filled duvets from Silk Sation, Last consulted Oct. 14, 2009, www.silksation.com/bliss_silk_comforter.html.

* cited by examiner

COVER FOR A MATTRESS

CROSS REFERENCE RELATED APPLICATIONS

This application is a national phase of PCT/CA2010/000305 filed Mar. 3, 2010, which claims priority to U.S. Provisional Application No. 61/157,044, filed Mar. 3, 2009, both of which are entirely incorporated herein by reference.

FIELD OF THE INVENTION

The present invention relates to bedding and the like. More particularly, and in its preferred intended use, the present invention relates to a cover for a mattress.

BACKGROUND OF THE INVENTION

Covers for mattresses and the like are well known in the art.

Indeed, a conventional cover typically consists of a removable fabric envelope shaped and sized so as to fit around a mattress. Such simple fabric covers typically comprise a single fabric sheet which can be folded around a mattress. Alternatively, the fabric sheet is sewn or otherwise joined so as to form corners and conform to the shape of the mattress without needing to be folded.

When installed on a mattress, such covers, whether formed from a single sheet or multiple joined portions, typically comprise a top panel for covering the top surface of the mattress and a lateral panel for covering the lateral surface of the mattress. Mattresses are typically rectangular in shape and that lateral surface comprises four sides, although it will be understood that other arrangements are possible.

It is not typically necessary to provide a sheet extending below the mattress since this side is not used or seen. It is however common for the lateral panel to extend downward beyond the lateral sides of the mattress so that they may be tucked underneath the mattress.

It is further known to provide an elastic material around the periphery of the mattress cover so as to facilitate retention of the cover on the mattress. In use, the elastic is stretched so as to allow installation of the cover on the mattress. Once installed, the elastic then pulls the periphery of the mattress cover inwards, underneath the mattress, thereby pulling the lateral sides and upper rectangular sheet taut.

Mattress covers are typically provided to fit the various conventional mattress sizes—twin, queen, king, and the like. However, these standard sizes reflect only the size of the top sheet, i.e. the bed's footprint. These sizes do not reflect the thickness of the mattress, that is to say the distance between the mattress's top and bottom surfaces.

It would be advantageous to provide a cover for a mattress which could accommodate a range of mattress thicknesses.

It is also known to provide a more substantial cover for a mattress comprised not just of fabric sheets but also of on or more layers of lining, padding, stuffing, wadding or the like. Such covers can provide an extra washable layer between the user and the mattress itself in order to absorb body excretions, such as sweat, or other potentially staining fluids and which could otherwise stain the mattress. As such, these covers are often called protectors. It is known to go so far as to provide mattress protectors with a polyester lining, or some other non-breathable, waterproof lining.

It is known that allergens and irritants such as dust mites, bed bugs, mold and dead skin may build up on and/or within a mattress. Dead skin and pet dander, which may be deposited on a mattress or mattress cover, may penetrate the mattress, thereby providing food for dust mites. Individuals who are susceptible to certain types of allergies, especially dust mites, may develop allergic reactions, asthma, and skin irritation such as eczema.

Previous attempts to prevent transmission of allergens and irritants include providing a polyurethane lining and chemically-treating an outer layer. It will be appreciated that these techniques have several known drawbacks.

In particular, German patent application no. DE 20 2004 006 745 (Friedrich) describes a material composition for bedding, pillows and mattresses comprising layers of silk, layers of horsehair or mixed layers of both silk and horsehair. Friedrich also describes layers of woven cotton fleece disposed between these layers.

Also known are the following patents and published patent applications: GB 454,452, U.S. Pat. No. 4,656,681, US 2007/0245493, JP 10-155623, WO 2003/030669, WO 2006/009974 and EP 1 576 908.

In light of the afore-mentioned, there remains a need for an improved cover for a mattress which, by virtue of its design and components, satisfies some of the needs which are known in the art and is thus an improvement over other related known covers.

SUMMARY OF THE INVENTION

An aspect of the present invention is to provide a cover for a mattress which, by virtue of its design and components, satisfies at least some of the above-mentioned needs and is thus an improvement over other related devices known in the prior art.

Indeed, according to a preferred embodiment of the present invention, there is provided a cover for a mattress having opposed top and bottom surfaces and a lateral surface extending therebetween. The cover includes a lateral panel for extending across the lateral surface of the mattress and a top panel for covering the top surface. The top panel is joined to the lateral panel. The top panel includes a breathable inner liner made of a non-woven material, a breathable outer shell covering the inner liner, and a silk floss fill retained between the inner liner and the outer shell.

According to another preferred embodiment of the present invention, there is provided a mattress including a core forming a top surface, a bottom surface and a lateral surface extending therebetween, and a top panel extending across the top surface. The top panel includes a breathable inner liner made of a non-woven material, a breathable outer shell covering the inner liner, and a silk floss fill retained between the inner liner and the outer shell.

Preferably, the lateral panel also includes a breathable inner liner made of a non-woven material, a breathable outer shell covering the inner liner, and a silk floss fill retained between the inner liner and the outer shell.

Preferably, the silk floss fill has a weight greater than about 60 grams per square meter (gsm), the outer shell is a woven cotton material and the inner liner has a weight of at least about 55 gsm. More preferably, the silk floss fill has a weight of at least about 80 gsm. Even more preferably, the silk floss fill has a weight between about 85 gsm and about 130 gsm, inclusively. Most preferably, the silk floss fill has a weight of about 85 gsm.

According to yet another preferred embodiment of the present invention, there is provided a cover for a mattress having opposed top and bottom surfaces and a lateral surface extending therebetween. The cover includes a top panel for covering the top surface, a lateral panel for extending across the lateral surface of the mattress and a peripheral portion of the bottom surface, and an adjustment feature. The lateral panel extends between the top panel and a peripheral edge. The adjustment feature includes a channel extending around the peripheral edge, an elongate elastic strip extending through the channel, a first connector fixed along the elongate elastic strip, and a plurality of second connectors fixed along the elongate elastic strip at increasing distances from the first connector. The first connector is connectable to each of the second connectors, thereby allowing the selection of the amount of elongate elastic strip extending around the peripheral edge.

The invention and its advantages will be better understood by reading the following non-restrictive description of a preferred embodiment thereof, made with reference to the accompanying drawings.

BRIEF DESCRIPTION OF THE DRAWINGS

The invention will be better understood upon reading the following non-restrictive description of the preferred embodiment thereof, made with reference to the accompanying drawings in which.

DETAILED DESCRIPTION OF PREFERRED EMBODIMENT OF THE INVENTION

In the following description, the same numerical references refer to similar elements. The embodiment shown in the figures is preferred, for exemplification purposes only.

In the context of the present description, the expression "mattress" includes various types of bedding as apparent to a person skilled in the art. For this reason, the expressions "cover", "protector", "slip" or "case" for example, should not be taken as to limit the scope of the present invention and includes other usages or items with which the present invention may be used and could be useful.

In addition, although the preferred embodiment of the present invention as illustrated in the accompanying drawings comprise various components, etc., and although the preferred embodiment of the cover and corresponding parts of the present invention as shown consist of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations therebetween, as well as other suitable geometrical configurations may be used for a cover according to the present invention, as will be briefly explained herein and as can be easily inferred herefrom by a person skilled in the art, without departing from the scope of the invention.

Figure 1:
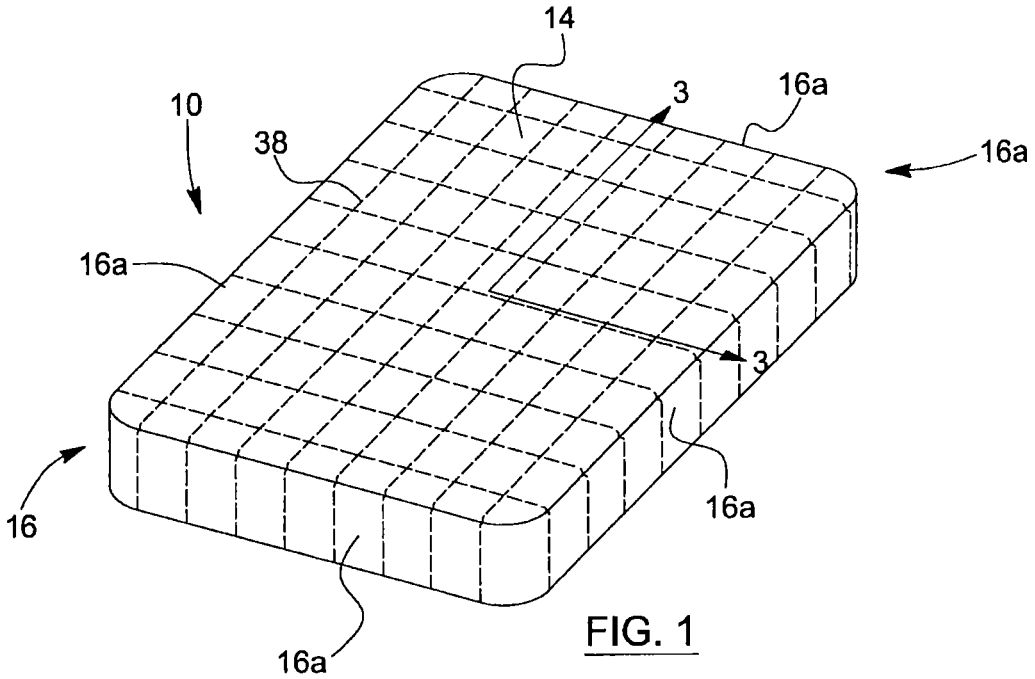
FIG. 1 is a perspective view of a cover for a mattress in accordance with a preferred embodiment of the present invention.
Figure 2:
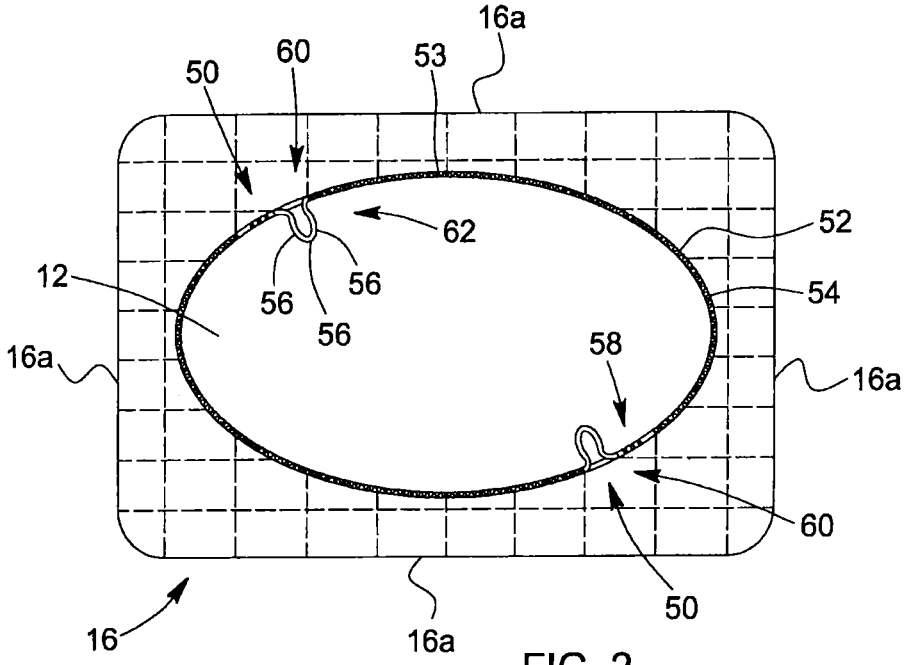
FIG. 2 is a bottom view of the cover in FIG. 1.

With reference to FIGS. 1 and 2, a cover 10 for a mattress 12 is illustrated. The mattress 12 includes top and bottom surfaces separated by a lateral surface which, in the illustrated embodiment, is composed of four sides. While four sides is common, it will be appreciated that differently shaped mattresses having more or less sides are also possible.

The mattress cover 10 comprises a top panel 14 which covers the top surface of the mattress. Preferably, the top panel 14 covers the entire top surface of the mattress 12. The cover 10 further includes a lateral panel 16 which extends across the lateral surface of the mattress 12. Given the rectangular shape of the mattress 12, the lateral panel 16 comprises a corresponding four lateral sections 16*a*. The lateral sections 16*a* each extend under the mattress 12 to cover a peripheral position of the bottom surface thereof.

Figure 3:
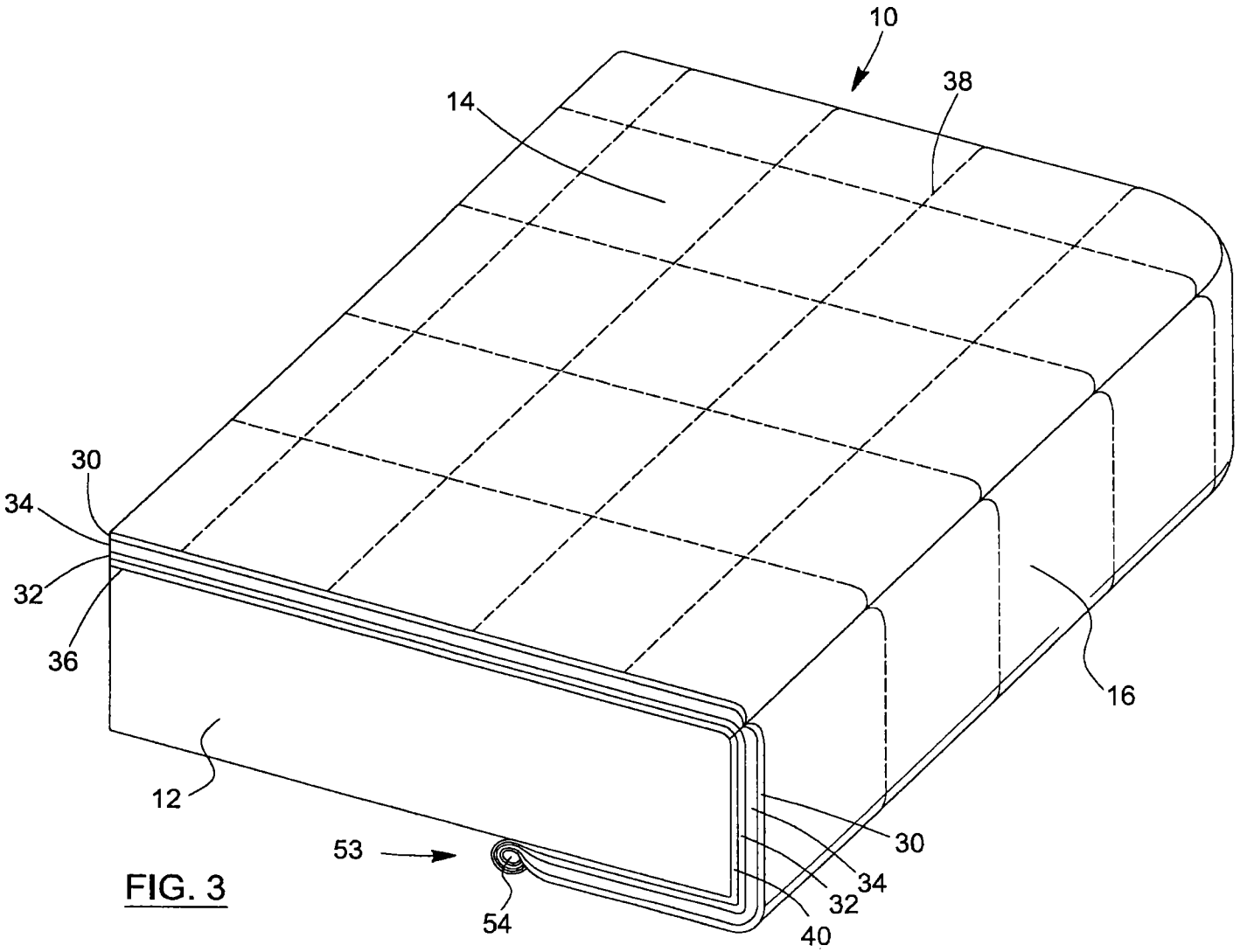
FIG. 3 is a cross-sectional view of the cover in FIG. 1 taken along line 3-3 of FIG. 1.

With additional reference now to FIG. 3, which illustrates schematically the cover 10 in cross-section, the top panel 14 comprises an outer layer 30, also called the outer shell 30, an inner layer 32, also called the inner liner 32, and a silk floss fill 34 which is disposed therebetween. Preferably, there is additionally provided a blocking layer 36 between the mattress 12 and the inner liner 32. All four layers 30, 32, 34 and 36 are breathable, i.e. they permit the flow of air therethrough.

The outer shell 30 is preferably a woven cotton material, and more preferably 100% cotton 233 count, although may be chosen from a variety of breathable cotton or poly-cotton blends. The inner liner 32 is a non-woven material, preferably made of polypropylene and having a weight equal or greater than about 40 grams per square meter (gsm). More preferably, the inner liner has a weight of at least 55 gsm.

The fill 34 is made of silk floss, preferably a naturally processed silk floss. It has been found that silk floss having a weight of greater than 60 gsm provides an advantageous combination of properties. More preferably, the silk floss fill 34 has a weight of at least about 80 gsm. A silk floss fill 34 having a weight of about 85 gsm has been determined as having a highly preferable combination of properties, including structural integrity, wicking and protection from irritants/allergens. A silk floss fill 34 having greater than 85 gsm may also have an advantageous combination of these properties, but will have the disadvantage of increased cost. One advantageous but economical embodiment would be a cover 10 having a silk floss fill 34 with a weight of at least about 85 gsm and less than about 130 gsm, inclusively.

It will be appreciated by one of ordinary skill in the art that the "weight" of the various layers discussed above, as measured in grams per square meter, is often referred to as the "basic weight" or the "density", of the given fabric or material. Moreover, it will also be appreciated that in practice the above-mentioned weights can rarely be specified exactly, but rather will often vary by 5%-10% for a given sample of the material.

In addition to providing a breathable wicking layer, the silk fill 34 is provided to block allergens and irritants which might be present on or within the mattress. Moreover, silk is a natural product to which mites are adverse, and is therefore may therefore prevent irritation. Silk floss advantageously provides fire retardant properties. Furthermore, the silk core 34 draws sweat away from the outer layer, i.e. that which is in contact with the user's skin. This ability to draw away moisture, known as wicking, aids in keeping the user cool during their sleep. This is especially beneficial for users such as menopausal women who are prone to sweat a greater than average amount during the night.

Preferably, the layers 30, 32 and 34 of the top panel 14 are quilted, that is to say they are connected to one another by a plurality of stitches 38 which extend longitudinally and transversely across and through the top panel 14. The quilting preferably takes the form of a linear grid. A grid of 4¼ inch by 4¼ inch squares is preferred, although it will be appreciated that various other quilting patterns could similarly be used, including linear grids formed of rectangles or lozenges, or indeed a square grid of different dimensions. It has been determined that this 4¼ inch grid size advantageously ensures the stability of the silk floss fill 34 while maintaining maximizing the comfort provided by this lining material. Of course, the stitching could form various patterns of various sizes without departing from the scope of the present invention.

The blocking layer 36, however, is not quilted, but rather attached to other layers 30, 32 and 34 along the edges of the top panel 14. While quilting layers of fabric helps stabilize the various fabric layers of the cover 10, the holes made by the stitches 38 have been found to allow the passage of body fluids produced by a user to the mattress below. The blocking layer 36 therefore provides non-quilted, non-woven layer, preferably of the same biodegradable material as the inner liner 32, which will aid in blocking such body fluids and thereby reduce damage to the mattress 12.

For users who are mainly concerned with keeping cool during sleep, the cover 10 may be provided with a lateral panel 16 which does not include the inner liner 32 or the silk fill 34 since the desired wicking properties are not required along the sides of the mattress 12. Such a lateral panel 16 could be provided as an extension of the outer shell 30 of the top layer 14, although it will be appreciated that other arrangements are also possible.

However, in order to block allergens and irritants which might be present on or within the mattress 12, the lateral panel 16 preferably also comprises the aforementioned layers—that is an outer shell 30, an inner liner 32 and the silk floss fill 34. The lateral panel 16 preferably further comprises an additional layer 40 which is made of a similar material to that of the outer shell 30, i.e. a woven, quilted, cotton material.

It has also been determined that the preferred embodiment detailed above advantageously provides a cover 10 with a silk floss fill 34 which maintains its integrity of wicking away perspiration and protects users from irritants and allergens over a minimum of 25 washes, while remaining cost effective to manufacture and market. It has also been determined that the preferred embodiment advantageously provides a cover 10 which protects the mattress 12 from bodily fluids while being light and soft enough not to be noticeable by a user, while being able to retain its integrity and not pill (i.e. form protruding fibers) and disintegrate when washed.

Figure 4:
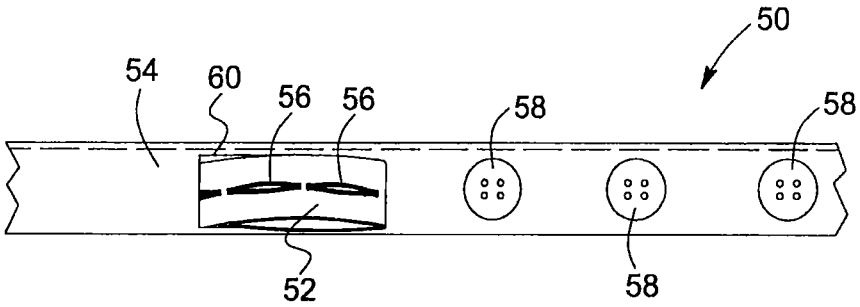
FIG. 4 is a close up of the adjustment feature seen in FIG. 2.

With additional reference to FIG. 4, an adjustment feature 50 is described which can be provided as part of the cover 10. As seen in FIG. 2, the lateral panel 16 extends across a peripheral portion of the bottom surface of the mattress 12. An elongate elastic strip 52 extends in a channel 54 which is sewn into the peripheral edge 53 of the lateral panel 16. Preferably, the channel 54 is formed by creating a hem along the edge 53. This band 52 is free to stretch within the channel 54, but is preferably anchored at least one point there.

The adjustment feature 50 further includes at least one first connector 58 fixed along the channel 54 and a plurality of complementary second connectors 56 positioned across the band 52. The first connector 58 is preferably fixed in line with the channel 54, but it will be appreciated that it could also be attached at other positions proximate thereto and still accomplish the same task. The first connector 58 is connectable to each of the second connectors 56, thereby allowing the user to isolate a section 62 of the band 52, effectively shortening it, and draw more of the lateral panel 16 under the mattress 12.

In the preferred embodiment illustrated, three first connectors 58 are provided so as to distribute the tension within the band 52 and/or strengthen the connections between the first and second connectors 58 and 56. It will be appreciated however that only one first connector 58 is required.

As illustrated, the first and second connectors 58 and 56 are embodied by buttons and button holes, respectively. However, it will be appreciated that various other combinations of complementary connectors 58 and 56 may similarly be employed.

In use, the user can draw an appropriate amount of the band 52 out of the channel 54 through an opening 60 and fix that isolated section 62 to the lateral panel 16 by attaching three of the button holes 56 to the three buttons 58. This adjustment of the lateral panel 16 advantageously allows the cover 10 to adjust for various thicknesses of mattress 12. The number and distribution of button holes 56 will vary in accordance with the number of different sizes of mattress 12 that are to be accommodated. Preferably, the second connectors 56 are provided all the way around the band 52.

In FIG. 2, the isolated section 62 of the band 52 is seen forming a loop which is brought outside the channel 54 via the opening 60. The button holes 56 have not yet been connected to their respective buttons 58. Preferably, and as illustrated, the adjustment feature 50 comprises a second set of connectors 56 and 58 at a second opening 60. These two sets of connectors 56 and 58 and openings 60 are preferably provided substantially opposite to one another.

Preferably, the adjustment feature is operable to accommodate mattresses thicknesses of 7 inches to 15 inches, or even 21 inches. It will be appreciated that various other ranges may similarly be provided for.

Figure 5:
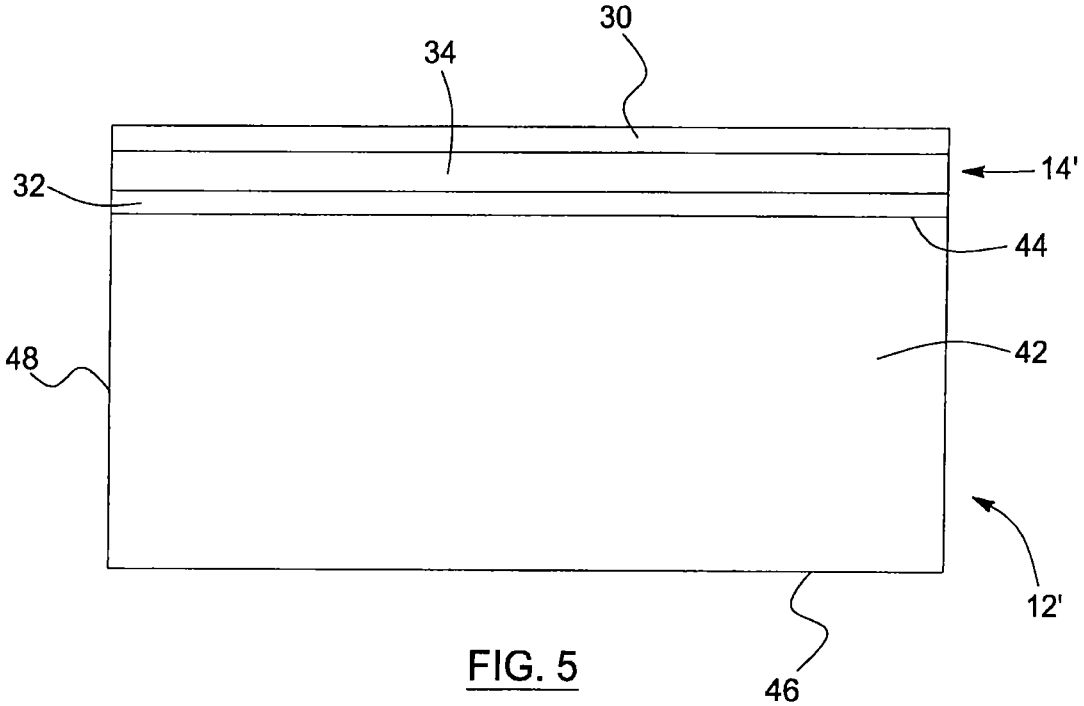
FIG. 5 is a schematic representation of a cross-sectional view of a mattress in accordance with another embodiment of the present invention.

While the layers 30, 32 and 34 can be embodied in a cover 10 as described above, and thereby be used around a variety of conventional mattresses 12, it will be appreciated that this advantageous structure can similarly be incorporated directly into a mattress. With additional reference to FIG. 5, a mattress 12' comprises a core 42 having a top surface 44, a bottom surface 46 and a lateral surface 48 extending therebetween. This core 42 represents a typical mattress body. Atop the core 42, a top panel 14' is provided which extends across the top surface 44. As with the previous embodiments, this top panel 14' comprises a breathable outer layer 30, a breathable inner liner 32 and a silk floss fill 34 retained therebetween as described above.

While the illustrated mattress 12' only comprises the layers 30, 32 and 34 over the top surface 44, it will be further appreciated that such layers could also be provided across the lateral surface 48. The top panel 14' could be provided as an integral part of the mattress 12' or could fixed to the core 42 with connectors so as to allow for its detachment for washing and/or replacement.

It will also be appreciated that the top panel 14' of the mattress 12', or indeed the cover 10, can be used in combination with other layers, such as feather beds, foam or other mattress toppers known in the art. For example, it will be appreciated that the cover 10 can further be provided with an extra fill of polyester, feather, or foam, to add an extra comfort layer to an existing mattress. This extra fill layer could be positioned between the inner liner 32 and blocking layer 36.

It will be appreciated that a cover 10 in accordance with the present invention advantageously provides a mattress cover which is washable and dryable.

As being now better appreciated, the present invention is an improvement and presents several advantages over other related devices and/or methods known in the prior art.

Of course, numerous modifications could be made to the above-described embodiment without departing from the scope of the invention, as apparent to a person skilled in the art.

The invention claimed is:

1. A cover for a mattress having opposed top and bottom surfaces and a lateral surface extending therebetween, the cover comprising:

a lateral panel for extending across the lateral surface of the mattress; and a top panel for covering the top surface, the top panel joined to the lateral panel, the top panel and the lateral panel comprising:

i. a breathable polypropylene inner liner made of a non-woven material;

ii. a woven breathable outer shell covering the inner liner; and iii. a silk floss fill retained between the inner liner and the outer shell, the silk floss fill having a weight between about 80 gam and about 130 gsm, inclusively.

2. The cover of claim 1, wherein the silk floss fill has a weight of about 85 gsm.

3. The cover of claim 1, wherein the outer shell is composed of a cotton material.

4. The cover of claim 3, wherein the outer shell is a 233 count cotton.

5. The cover of claim 1, wherein the inner liner has a weight greater than about 40 gsm.

6. The cover of claim 5, wherein the inner liner has a weight of at least about 55 gsm.

7. The cover of claim 1, wherein the inner liner, the silk floss fill and the outer shell are quilted.

8. The cover of claim 7, wherein the top panel further comprises a blocking layer adjacent the breathable inner liner and opposite the silk floss fill, the blocking layer not being quilted.

9. The cover of claim 1, wherein the lateral panel is an extension of the outer shell.

10. The cover of claim 1, wherein the outer shell of the lateral panel a 233 count woven cotton material.

11. The cover of claim 1, wherein the inner liner of the lateral panel has a weight of about 55 gsm.

12. The cover of claim 1 wherein the inner liner of the lateral panel, the silk floss fill of the lateral panel and the outer shell of the lateral panel are quilted.

13. A mattress comprising:

a) a core forming a top surface, a bottom surface and a lateral surface extending therebetween, and b) a top panel extending across the top surface and a lateral panel extending across the lateral surface of the mattress, the top panel and the lateral panel comprising:

i. a breathable polypropylene inner liner made of a non-woven material;

ii. a woven breathable outer shell covering the inner liner; and iii. a silk floss fill retained between the inner linear and the outer shell, the silk floss fill having a weight between about 80 gsm and about 130 gsm, inclusively.

* * * * *